US006048279A

United States Patent [19]

Masutani

[11] Patent Number: 6,048,279

[45] Date of Patent: Apr. 11, 2000

[54] GOLF BALL

[75] Inventor: Yutaka Masutani, Saitama, Japan

[73] Assignee: Bridgestone Sports Co., Ltd., Tokyo, Japan

[21] Appl. No.: 09/149,048

[22] Filed: Sep. 8, 1998

[30] Foreign Application Priority Data

Sep. 8, 1997 [JP] Japan ..... 9-242537

[51] Int. Cl.[7] ..... A63B 65/06; A63B 37/04

[52] U.S. Cl. ..... 473/372; 473/360

[58] Field of Search ..... 473/354, 385, 473/360, 373, 359

[56] References Cited

U.S. PATENT DOCUMENTS 1,568,514 1/1926 Lewis ..... 473/354 X
3,031,194 4/1962 Strayer ..... 473/385 X
5,913,736 6/1999 Maehara et al. ..... 473/360

FOREIGN PATENT DOCUMENTS 60-14877 1/1985 Japan .

*Primary Examiner*—Jeanette Chapman
*Assistant Examiner*—Mitra Aryanpour
*Attorney, Agent, or Firm*—Sughrue, Mion, Zinn Macpeak & Seas, PLLC

[57] ABSTRACT

Disclosed is a golf ball including a metallic layer disposed between an inner core and an outer core. The distance between the center of the inner core and the inner surface of the metallic layer is not greater than 15 mm, and the weight of the metallic layer is 0.2 g to 4.0 g. The metallic layer is preferably formed from nickel and through plating. The moment of inertia of the golf ball is reduced without impairing physical properties of a core rubber. The golf ball exhibit an excellent spin motion while maintaining good resilience.

5 Claims, 1 Drawing Sheet

GOLF BALL

BACKGROUND OF THE INVENTION

1. Field of the Invention

The present invention relates to a golf ball whose moment of inertia is reduced to thereby exhibit excellent spin motion.

2. Related Art

A golf ball exhibiting a relatively low moment of inertia during travel is disclosed in JP-A-1985-14877. The golf ball is composed of an inner core, an intermediate layer, and a cover. A large amount of a weight adjusting agent, such as a metal oxide powder, is added to rubber which is used to form the inner core, to thereby increase the specific gravity of the inner core and thus reduce the moment of inertia of the golf ball.

However, in the golf ball disclosed in JP-A-1985-14877, due to an addition of a large amount of a weight adjusting agent, such as a metal oxide powder, to the inner core rubber, the inner core rubber is apt to become hard and brittle. As compared to rubber containing no weight adjusting agent, rubber containing a weight adjusting agent tends to exhibit impaired resilience. This tendency increases with the amount of an added weight adjusting agent. Accordingly, the golf ball of JP-A-1985-14877 has a limit to the amount of a weight adjusting agent to be added to the inner core without impairing physical properties of the inner core rubber. Thus, the moment of inertia of the golf ball cannot be reduced to a sufficiently low value.

SUMMARY OF THE INVENTION

The present invention has been achieved in view of the foregoing. An object of the present invention is to provide a golf ball whose moment of inertia is reduced without impairing physical properties of a core rubber to thereby exhibit an excellent spin motion while maintaining good resilience.

To achieve the above object, the present invention provides a golf ball comprising an inner core, an outer core, and a metallic layer disposed between the inner and outer cores. The distance between the center of the inner core and the inner surface of the metallic layer is not greater than 15 mm. Also, the metallic layer has a weight of 0.2 g to 4.0 g.

In the golf ball of the present invention, the metallic layer is disposed between the inner core and the outer core, and the distance between the center of the inner core and the inner surface of the metallic layer is made not greater than 15 mm, thereby disposing a relatively heavy weight in the vicinity of a central portion of the golf ball and thus reducing the moment of inertia of the golf ball. In contrast to the golf ball of JP-A-1985-14877 whose physical properties would be impaired if a weight adjusting agent, such as a metal oxide powder, were added in an excessive amount in an attempt to sufficiently reduce the moment of inertia of the golf ball, the golf ball of the present invention does not require an addition of a weight adjusting agent to an inner core rubber in order to reduce its moment of inertia, thereby avoiding an impairment in its resilience. Also, the degree of a reduction in the moment of inertia can be adjusted over a wide range through selection of a relevant weight of the metallic layer. Thus, the golf ball of the present invention enables reduction of moment of inertia to a desired extent while good resilience is held intact. Accordingly, the present invention provides a golf ball exhibiting good resilience and an excellent spin motion.

DESCRIPTION OF THE INVENTION AND THE PREFERRED EMBODIMENT

Figure 1:
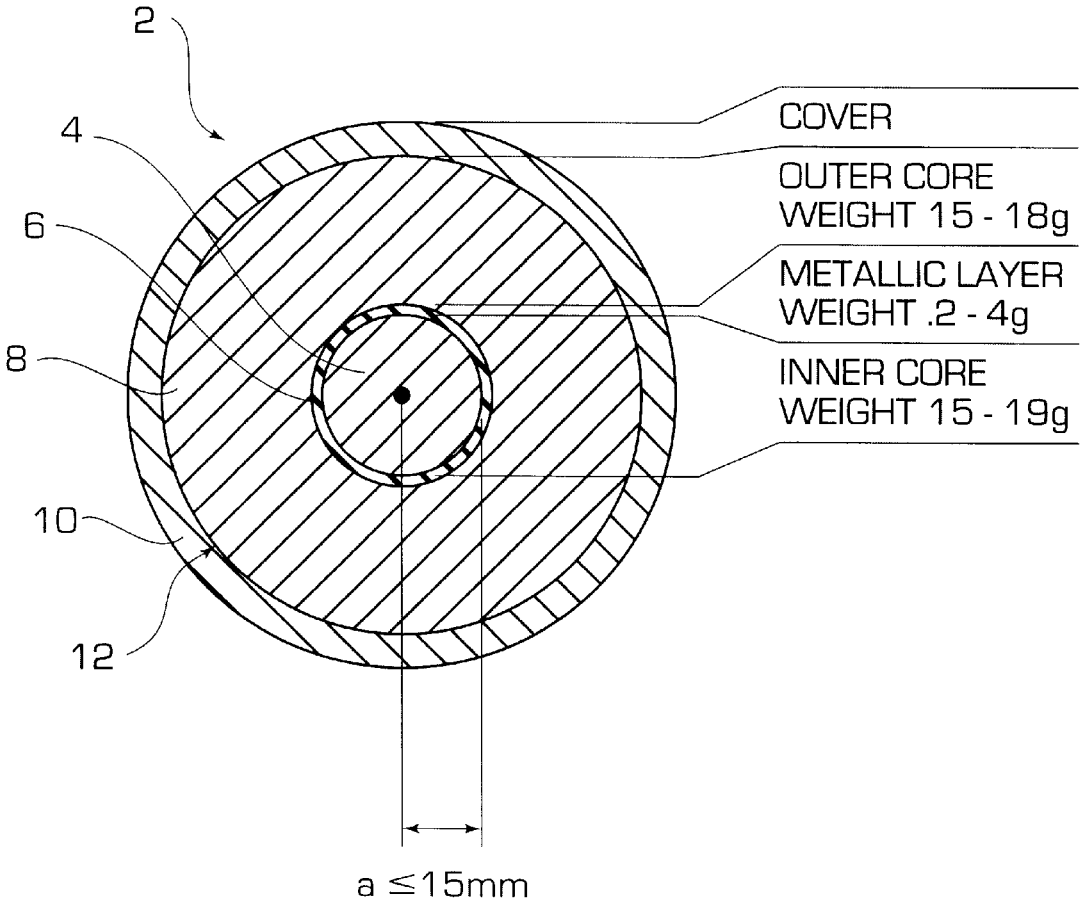
FIG. 1 is a sectional view showing an embodiment of a golf ball according to the present invention.

The present invention employs a metallic layer disposed between an inner core and an outer core. The material for the inner and outer cores is not particularly limited. A core material example is vulcanized rubber which contains as a main component polybutadiene rubber, polyisoprene rubber, natural rubber, silicone rubber, or like rubber. Preferably, vulcanized rubber containing polybutadiene rubber as a main component is used. The inner and outer cores may each have a single-layered structure made of a single type of material or a multi-layered structure composed of a plurality of layers each made of a different type of material.

The material for the metallic layer is not particularly limited. Examples of a metallic layer material include nickel, aluminum, copper, lead, zinc, tin, gold, silver, platinum, and like metal. Preferably, nickel is used in view of manufacturing cost, specific gravity, etc.

A method for disposing the metallic layer between the inner core and the outer core may be, for example, any of the following (1) to (3), but is not limited thereto.

(1) The metallic layer is formed on the surface of the inner core. Subsequently, the inner core is covered with the outer core through compression molding or like processing.

(2) A pair of hemispheric cups serving as the outer core is lined with the metallic layer. Subsequently, the inner core is covered with the hemispheric cups through compression molding or like processing.

(3) The metallic layer is formed on the surface of the inner core, and a pair of hemispheric cups serving as the outer core is lined with the metallic layer. Subsequently, the inner core is covered with the hemispheric cups through compression molding or like processing.

The metallic layer may be formed through, for example, plating, vacuum deposition, sputtering, chemical vapor deposition, or like processing. Preferably, plating is used, since the thickness of the metallic layer can be readily made uniform. The metallic layer having a uniform thickness prevents eccentric rotation of a golf ball. For example, when a layer is formed from a material having a high specific gravity in the vicinity of a central portion of a golf ball in order to reduce the moment of inertia of the golf ball and the formed layer has a nonuniform thickness, eccentric rotation of the golf ball occurs during traveling, resulting in an impairment in traveling performance of the golf ball. The metallic layer having a uniform thickness formed through plating solves the eccentric-rotation problem.

When the metallic layer is to be formed through plating, a surface to be plated (for example, the surface of the inner core) is made electrically conductive through, for example, vacuum deposition, coating with a conductive material, electroless plating, or like processing. The thus-treated surface is subjected to electroplating, electroless plating, or like plating. Preferably, a surface to be plated is made electrically conductive through electroless plating, and then the thus-treated surface is subjected to electroless plating or electroplating in view of higher accuracy in the thickness of a plating layer and higher adhesion between the plating layer and the plated surface.

In the present invention, the distance between the center of the inner core and the inner surface of the metallic layer is not greater than 15 mm. When the distance is in excess of 15 mm, the moment of inertia of a golf ball is not sufficiently reduced. The distance is preferably 5.0 mm to 15.0 mm, more preferably 8.0 mm to 14.0 mm. When the distance is less than 5.0 mm, a golf ball is apt to become eccentric during manufacture, resulting in a potential failure to exhibit a hop in a ballistic trajectory.

In the present invention, the weight of the metallic layer is 0.2 g to 4.0 g. When the weight of the metallic layer is less than 0.2 g, the moment of inertia of a golf ball is not sufficiently reduced. When the weight of the metallic layer is in excess of 4.0 g, a golf ball weight fails to conform to the Rules of Golf even though the weight of other members are reduced. The weight of the metallic layer may be selected within the above range according to a desired moment of inertia, but is preferably 1.5 g to 3.5 g, more preferably 2.0 g to 3.0 g.

In the present invention, preferably, the weight of the inner core is 15.0 g to 19.0 g, and the weight of the outer core is 15.0 g to 18.0 g. When an inner core weight and an outer core weight do not fall within the above respective ranges, the moment of inertia of a golf ball may not be sufficiently reduced. More preferably, the weight of the inner core is 17.0 g to 19.0 g, and the weight of the outer core is 15.0 g to 17.0 g. An inner core weight and an outer core weight can be adjusted through, for example, adjustment of the specific gravity of the inner and outer cores, which, in turn, are adjusted through adjustment of the amount of a weight adjusting agent added to inner and outer core rubbers.

The golf ball of the present invention is manufactured in the following manner. A sphere composed of the inner core, the outer core, and the metallic layer disposed between the inner and outer cores (hereinafter the sphere may be referred to merely as a core) is enclosed with a cover material through compression or injection molding, during which dimples are formed on the cover. Subsequently, the thus-formed golf ball undergoes, as needed, finishing processing such as coating, mark stamping, etc. The material for the cover is not particularly limited. Examples of a cover material include an ionomer resin, a urethane resin, a polyester resin, a mixture of a polyester resin and an urethane resin, or a like resin. The size and weight of the golf ball of the present invention conforms to the Rules of Golf. Accordingly, the golf ball is required to have a diameter not smaller than 42.67 mm and a weight not greater than 45.93 g.

Referring to FIG. 1, which shows an embodiment of a golf ball of the present invention, a golf ball 2 is manufactured by the steps of forming a metallic layer 6 on the surface of an inner core 4; forming an outer core 8 on the surface of the metallic layer 6 through molding to thereby obtain a core 12; and enclosing the core 12 with a cover 10. A distance a between the center of the inner core 4 and the inner surface of the metallic layer 6 is set to 15 mm or less, and the weight of the metallic layer 6 is set to 0.2 g to 4.0 g.

The golf ball 2 of the present embodiment may be manufactured in the following procedure. However, the manufacturing procedure is not limited thereto.

(1) The inner core 4 is formed from vulcanized rubber through compression molding. Subsequently, the metallic layer 6 is formed on the surface of the inner core 4 through plating.

(2) Two hemispheric cups, which will become the outer core 8, formed from unvulcanized rubber are subjected to primary vulcanization (semi cure). Then, the inner core 4 plated with the metallic layer 6 is enclosed with the two hemispheric cups. Subsequently, the hemispheric cups are subjected to secondary vulcanization (full cure) so that the hemispheric cups are joined to each other, to thereby form the core 12 composed of the inner core 4, the outer core 8, and the metallic layer 6 interposed between the inner core 4 and the outer core 8.

(3) The core 12 is enclosed with the cover 10 through compression or injection molding, during which dimples are formed on the cover 10.

EXAMPLES

Golf balls of Examples 1 and 2 and Comparative Examples 1 to 4 shown in Table 1 were manufactured. The golf balls of Examples 1 and 2 and Comparative Examples 3 and 4 were each composed of an inner core, an outer core, and a metallic layer disposed between the inner and outer cores and manufactured according to the procedure (1)–(3) described above. The metallic layer was formed by the steps of: plating an inner core surface with nickel through electroless plating to thereby impart electric conductivity to the surface; and further plating the inner core surface with nickel through electroless plating. A golf ball of Comparative Example 2 was a two-piece ball using a single-layered core. The composition of the core is shown in the field "Composition of Inner Core" of Table 1.

In Table 1, a base rubber was obtained by blending JSR BR01 and JSR BR11 (trade names of polybutadiene rubbers manufactured by Japan Synthetic Rubber Co., Ltd.) at the weight ratio 50:50; a vulcanizer was PERCUMYL D (trade name of a dicumyl peroxide manufactured by Nippon Oil & Fats Co., Ltd.); a hardener was zinc acrylate; a cover composition A was obtained by blending HIMILAN 1605 and HIMILAN 1706 (trade names of ionomer resins manufactured by Du Pont Mitsui Polychemicals Co., Ltd.) at the weight ratio 50:50; and a cover composition B was SURLYN 1652 (trade name of an ionomer resin manufactured by Du Pont, Ltd.). A cover was formed through injection molding.

TABLE 1

| | Examples | | Comparative Examples | | | |
|---|---|---|---|---|---|---|
| | 1 | 2 | 1 | 2 | 3 | 4 |
| Composition of Inner Core (parts by weight) | | | | | | |
| Base rubber | 100 | 100 | 100 | 100 | 100 | 100 |
| Zinc oxide | 124 | 97 | 124 | 75 | 75 | 75 |
| Vulcanizer | 1.5 | 1.5 | 1.5 | 1.5 | 1.5 | 1.5 |
| Hardener | 30 | 30 | 30 | 30 | 30 | 30 |
| Diameter of Inner Core (mm) | 28.4 | 26.3 | 28.0 | 37.2 | 32.7 | 28.7 |
| Weight of Inner Core (g) | 19.1 | 16.3 | 19.0 | 35.4 | 30.9 | 18.0 |
| Metallic layer | | | | | | |
| Material | Ni | Ni | — | — | Ni | Ni |
| Weight (g) | 0.21 | 4.0 | — | — | 0.1 | 5.0 |
| Distance a (mm) | 14.2 | 13.15 | — | — | 16.35 | 14.35 |
| Outer diameter (mm) | 28.8 | 29.1 | — | — | 32.9 | 29.3 |
| Composition of Outer Core (parts by weight) | | | | | | |
| Base rubber | 100 | 100 | 100 | — | 100 | 100 |
| Zinc oxide | 1.2 | 1 | 2 | — | 75 | 1 |
| Vulcanizer | 1.5 | 1.5 | 1.5 | — | 1.5 | 1.5 |
| Hardener | 30 | 27 | 30 | — | 30 | 27 |
| Cumulative Weight of Outer Core (g) | 35.8 | 35.9 | 35.8 | — | 35.7 | 35.5 |
| Cover | | | | | | |
| Composition | A | A | B | B | A | A |
| Hardness (Shore D) | 64 | 64 | 64 | 64 | 64 | 64 |

TABLE 1-continued

| | Examples | | Comparative Examples | | | |
|---|---|---|---|---|---|---|
| | 1 | 2 | 1 | 2 | 3 | 4 |
| Golf Ball | | | | | | |
| Diameter (mm) | | | | | | |
| Weight (g) | 45.2 | 45.3 | 45.3 | 45.1 | 45.2 | 45.3 |
| Hardness (PGA hardness meter) | 96 | 95 | 98 | 100 | 96 | 96 |
| Moment of Inertia | 74 | 73.2 | 75.6 | 79.8 | 76.3 | 75.8 |
| Travel Test: W#1, HS45 | | | | | | |
| Initial speed (m/s) | 77.01 | 77.05 | 77.1 | 77.02 | 77.12 | 76.7 |
| Rate of spin (rpm) | 3521 | 3650 | 3395 | 2897 | 2925 | 3310 |
| Carry (m) | 197 | 199 | 195 | 182 | 186 | 183 |
| Ballistic trajectory | ○ | ○ | ○ | x | x | x |

The golf balls of Examples 1 and 2 and Comparative Examples 1 to 4 were measured for moment of inertia and subjected to a travel test. The measurement and test were performed as follows:

Measurement of Moment of Inertia

The moment of inertia was measured through use of a moment-of-inertia measuring device (M01-005 manufactured by INERTIA DYNAMICS INC.). The moment of inertia of each golf ball was calculated based on the difference between the period of vibration as measured when the golf ball was placed on a jig of the device and that when the golf ball was not placed on the jig.

Travel Test

Through use of a hitting test machine, the golf balls were hit by the No.1 Wood at a head speed of 45 m/s (HS45). An initial speed, a rate of spin, a carry, and a ballistic trajectory were measured. A ballistic trajectory was evaluated according to the following criteria.

o: A hop was observed in a ballistic trajectory.

x: A hop was not observed in a ballistic trajectory, so that the trajectory was rather flat.

The test results are shown in Table 1 and provide the following findings.

(a) The golf balls of Examples 1 and 2 exhibit a great reduction in moment of inertia as compared to the golf ball of Comparative Example 2, which is a conventional two-piece ball using a single-layered solid core. Accordingly, the balls of Examples 1 and 2 exhibit a ballistic trajectory having a hop effected through intensive spin and provide a long carry.

(b) The ball of Comparative Example 1 is that of JP-A-1985-14877 described previously. In the balls of Example 1 and Comparative Example 1, inner cores contain the same amount of a metal oxide powder and have substantially the same weight and diameter. Because the metallic layer is present, the ball of Example 1 exhibits a greater reduction in moment of inertia than does the ball of Comparative Example 1.

(c) In Example 1 and Comparative Example 1, inner cores contain a considerably large amount of a metal oxide powder. If more metal oxide powder is added, core resilience may decrease. Accordingly, for the ball of JP-A-1985-14877, the moment of inertia (about 75.6) exhibited in Comparative Example 1 is almost a feasible lower limit. By contrast, in Example 1, the weight of the metallic layer is near a lower limit, but the moment of inertia exibited is lower than that exhibited in Comparative Example 1. This indicates that the golf ball of the present invention enables adjustment of the degree of a reduction in moment of inertia over a wide range through selection of a relevant weight of the metallic layer while good core resilience is held intact.

(d) In the ball of Comparative Example 3, the distance between the center of the inner core and the inner surface of the metallic layer is in excess of 15 mm, and the weight of the metallic layer is less than 0.2 g. The ball fails to provide a sufficient effect of reducing moment of inertia and to provide a ballistic trajectory having a hop effected through intensive spin.

(e) In the ball of Comparative Example 4, the distance between the center of the inner core and the inner surface of the metallic layer is not greater than 15 mm, but the weight of the metallic layer is greater than 4 g. The ball fails to provide a sufficient effect of reducing moment of inertia and to provide a ballistic trajectory having a hop effected through intensive spin.

What is claimed is:

1. A golf ball comprising a solid inner core, an outer core, a plated metallic layer disposed between said inner and outer cores, wherein the distance between the center of said inner core and an inner surface of said metallic layer is in the range of 5.0 mm to 15.0 mm, and said metallic layer has a weight in the range of 0.2 g to 4.0 g., the weight of the inner core is in the range of 15.0 g to 19.0 g, the weight of the outer core is in the range of 15.0 g to 18.0 g, and the material for the inner and outer cores is vulcanized rubber containing polybutadiene rubber as a main component.

2. A golf ball according to claim 1, wherein said metallic layer is formed from nickel.

3. A golf ball according to claim 1, wherein the distance between the center of the inner core and the inner surface of the metallic layer is 8.0 mm to 14.0 mm.

4. A golf ball according to claim 1, wherein the weight of the metallic layer is 1.5 g to 3.5 g.

5. A golf ball according to claim 1, wherein the weight of the metallic layer is 2.0 g to 30 g.

* * * * *